United States Patent [19]

Michalski

[11] Patent Number: 4,706,962

[45] Date of Patent: Nov. 17, 1987

[54] DART BOARD WITH TARGET PLATES STRUCTURED AS DISCRETE GRIDS

[75] Inventor: David E. Michalski, Rockford, Ill.

[73] Assignee: Arachnid, Inc., Rockford, Ill.

[21] Appl. No.: 867,057

[22] Filed: May 27, 1986

[51] Int. Cl.[4] ..... F41J 3/00

[52] U.S. Cl. ..... 273/347; 273/283

[58] Field of Search ..... 273/347, 408, 376, 287, 273/283, 249, 260, 261, 403

[56] References Cited

U.S. PATENT DOCUMENTS

| | | | |
|---|---|---|---|
| 1,167,394 | 1/1916 | Foster | 273/283 |
| 1,912,873 | 6/1933 | Vanhoutteghem | 273/408 |
| 3,524,647 | 8/1970 | Studen | 273/408 |
| 4,057,251 | 11/1977 | Jones et al. | 273/376 |
| 4,257,613 | 3/1981 | Meyer Thor Straten | 273/347 |
| 4,635,940 | 1/1987 | Kelley | 273/347 |

*Primary Examiner*—Paul E. Shapiro

*Attorney, Agent, or Firm*—Leydig, Voit & Mayer

[57] ABSTRACT

A dart board in which the various target plates are conveniently assembled onto the dart board target area. The target plates of the board which have the same color are molded at the same time in the form of a grid in which each of the target plates is linked to one or more of the adjacent target plates in order to form an integral grid-like structure. The positions of the various target plates correspond to the positions of the respective scoring areas on the dart board. For a dart board in which the target plates are divided into separate scoring areas on the basis of just two distinct colors, two separate grids are provided, each constituting an integrally supported arrangement of target plates of one of the two distinct colors. The integral grids are designed in such a way that when positioned in an overlapping manner with respect to each other, they define the overall target plates of the dart board with immediately adjacent target plates being of different ones of the two distinct colors. Provision is made within the integral support structure of the dart board to accommodate the wafer grids along with the coupling links that define the grids. The assembly procedure for the dart board requires just the placement of the separate integral grids onto the dart board according to a predefined order without any need to take into account the separate shapes and colors of the individual target plates.

8 Claims, 5 Drawing Figures

DART BOARD WITH TARGET PLATES STRUCTURED AS DISCRETE GRIDS

FIELD OF THE INVENTION

This invention generally relates to a dart board for use in a "safe" dart game. More particularly, the present invention relates to an improved dart board which can be conveniently manufactured and permits easy assembly of the basic components.

BACKGROUND OF THE INVENTION

Safe dart games which may be used without fear of personal injuries or property damage are well known and becoming increasingly popular. Such dart games use unique safe darts which closely resemble conventional metal darts in appearance, flight characteristics and target striking characteristics, but which are virtually incapable of causing personal injury or damage to walls, furniture or other surroundings adjacent the dart board. The darts are identical to standard metal darts except that the safe darts include a slender tip made of flexible plastic and formed with a comparatively blunt point so that when a misthrown dart strikes a solid object, the flexible tip deflects laterally and the blunt point prevents the tip from penetrating the object. The misthrown dart hence bounces harmlessly away from the object rather than causing injury or damage.

The dart boards that are used with such safe dart games basically consist of an array of target plates molded with a large number of closely spaced holes which correspond substantially in size to the external diameter of the tip of the safe darts. The target plates of such dart boards are designed in such a way that when a dart is thrown at the board, the tip almost invariably enters one of the holes and remains there until it is removed. The dart board is also adapted so that the tip of a thrown dart can find its way into one of the holes on the target plates even if the tip initially strikes the plate in an area between adjacent holes.

As is conventional with such dart boards, the target plates are divided into different scoring areas with immediately adjacent scoring areas of target plates being of different colors. This requirement poses a significant problem to the dart board manufacturer from the point of view of assembly of the dart board components, because it is more convenient and economical to separately mold the individual target areas in their required colors rather than assemble the overall target area for the dart board first and then paint or color it so as to delineate the various scoring areas. Hence, according to common industry procedure, the distinctive scoring areas which constitute the overall target area of the dart board are separately molded in their required colors.

During assembly of the board, each of these scoring areas is then individually positioned into its corresponding position within the infrastructure that supports the dart board. This constitutes an extremely laborious and time consuming procedure since a conventional 'around the clock' dart board needs 81 separate scoring areas to be defined on its overall target area. The assembler on the dart board assembly line not only has to go through 81 separate motions of picking up a single scoring area and then placing it onto the target area of the dart board, but has to be alert enough to position the scoring area of the right shape as well as the right color into the corresponding position on the dart board target area. Not surprisingly, such conventional methods of assembly take an undue amount of time, are prone to a variety of assembly mistakes and constitute an uneconomical, laborious and inconvenient method of assembly. Thus, there exists a need for an improved method of assembly of the various differently colored scoring areas of the dart board which removes the disadvantages inherent to conventional assembly procedures.

SUMMARY AND OBJECTS OF THE INVENTION

Accordingly, it is a primary object of the present invention to provide an improved method of assembly for safe dart boards which enables the convenient assembly of the various scoring areas onto the target area of the dart board.

It is a related object to provide such an improved method of assembly which is significantly less susceptible to errors on the assembly line.

Another object of this invention is to provide such an improved assembly method which is adaptable for use with different color combinations of the various scoring areas of the dart board.

A further object is to provide such an improved assembly method which is adapted for efficient and economical manufacturing.

Another related object is to provide a dart board of the above type which is relatively stronger and less susceptible to dislodging of separate scoring areas.

The above objects are realized, according to this invention, by providing a grid like arrangement which links distinctive combinations of the various scoring areas of the dart board. More specifically, the scoring areas which are of the same color are molded at the same time in the form of a grid in which each of the scoring areas is linked to one or more of the adjacent scoring areas in order to form an integral structure. The positions of the various scoring areas located on such a grid are defined to correspond to the positions of the respective scoring areas on the target area of the dart board. Consider, for example, the simplified case where the target area of the dart board is divided into separate scoring areas on the basis of just two distinct colors. In this case, the target area can be composed of two separate grids, each constituting an integrally supported arrangement of scoring areas of one of the two distinct colors. The grids are designed in such a way that when positioned in an overlapping manner with respect to each other they define the overall target area of the dart board, with immediately adjacent scoring areas being of different ones of the two distinct colors.

The manufacturing process with such an arrangement is extremely simplified since the molding procedure is limited to producing the two distinctive grids as described above. A major advantage of such a grid like arrangement is the resulting convenience brought to the assembly operation. Instead of placing the various scoring areas individually onto the dart board, the assembly operator just has to place the separate integral grids onto the dart board infrastructure according to a predefined order without having to worry about the separate shapes and colors of the various scoring areas. Such an improved method of assembly results in an easy and less fatiguing assembly procedure which is significantly less prone to assembly errors and also produces a corresponding decrease in labor and time-related manufacturing costs.

In addition, the grid-like arrangement provides added strength to the board since the scoring areas are linked together, thereby reducing the likelihood of individual scoring areas getting dislodged from the target area.

Other objects and advantages of the invention will become apparent as the following description proceeds and when taken in conjunction with the accompanying drawings.

DETAILED DESCRIPTION OF THE PREFERRED EMBODIMENT

While the invention will be described in connection with the particular preferred embodiment, it will be understood that it is not intended to limit the invention to that particular embodiment. On the contrary, it is intended to cover all alternatives, modifications and equivalents as will be included within the spirit and scope of the invention as defined by the appended claims.

Figure 1:
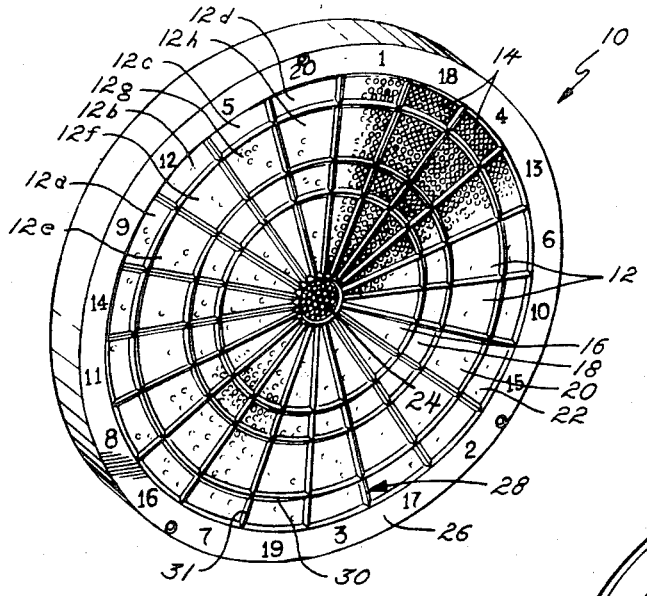
FIG. 1 is a perspective view of an improved dart board, according to this invention illustrating the basic structure and components of such an assembled dart board.
Figure 2:
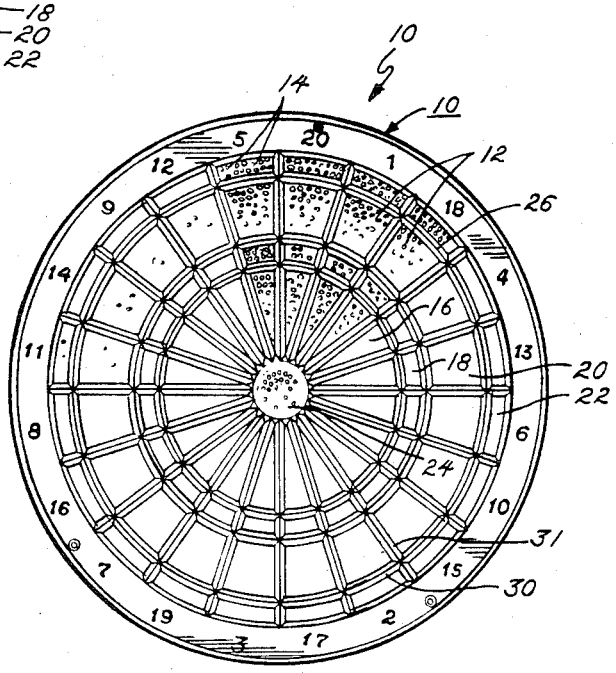
FIG. 2 is a top plan view of the illustrative dart board of FIG. 1.

Referring now to FIGS. 1 and 2 in combination, there is shown a perspective view of a conventional looking safe dart board according to this invention. The dart board 10 basically consists of a target area which includes an array of target plates or wafers 12 which are formed with a large number of very closely spaced holes 14 adapted for receiving the tip of a safe dart (not shown). Safe darts are well known and provide virtually the same appearance and flight characteristics as standard metal tipped darts but are of the safe type in the sense that they are incapable of causing severe damage to persons or equipment surrounding the dart board. Such darts generally have a conventionally shaped body made of plastic or wood with angularly spaced tail fins at the rear, and include a conventionally shaped dart tip which is formed from flexible plastic and terminates in a relatively blunt point as compared to the extremely sharp points of standard metal tipped darts. The tip is normally of circular cross section and tapers slightly while progressing outwardly to the point. Since the tip of the dart is of a flexible material, and has a blunt point, the dart tends to bounce off objects other than the specially constructed safe dart board. However, when the dart is thrown at the dart board, the tip of the dart either telescopes directly into one of the holes 14 or else strikes a portion of the wafer 12 adjacent the hole and is thereby deflected into the hole. The constructional details of the wafers and the holes which they comprise are fairly well known for further detail the reference is made at this point to U.S. Pat. No. 4,057,251 issued to Jones, et al. which describes the constructional details of a conventional safe dart board.

For purposes of this specification, it suffices to state that the wafers 12 are formed along with the holes 14 from a rigid plastic material by well known injection molding techniques. Each of the holes 14 is normally of circular cross section with a size and shape substantially corresponding to the size and shape of the tip of the dart. The tip of the safe dart is generally tapered upwards from its striking end to a diameter which is slightly larger than that of the inner surface of the holes so that the tip of a safe dart may enter freely into a hole, but subsequently tends to wedge inside the hole, thereby insuring that a thrown dart does not fall off the dart board once it penetrates one of the wafer holes. As is also conventionally known, the outer end of each hole 14 is enlarged and formed with an inwardly tapered bevel and this feature in conjunction with the narrow center-to-center spacing between adjacent holes provides only narrow ribs between the holes so that when a dart strikes the dart board in such a way that its tip strikes a rib between adjacent holes, the rib tends to lead the dart into a hole rather than allowing it to bounce away from the board 10.

Returning to FIG. 1, the board 10 has a conventional construction and is composed of 81 wafers 12 arranged in a circular fashion and disposed in edge-to-edge relation so as to delineate different scoring areas having different designated score values. The target area for the board is divided into four circumferentially extending and radially spaced rows of wafers 16, 18, 20 and 22. Each of these rows contains 20 wafers. The wafers of different rows are of different trapezoidal shapes as shown in FIGS. 1 and 2. The last wafer is in the form of a single circular wafer 24 which is located at the center of the dart board 10 and defines the bulls-eye. It will be apparent that the second circumferential row of wafers 18 and the fourth circumferential row of wafers 22 correspond respectively to the "triple score" rings and the "double score" rings in conventional dart boards.

The dart board 10 is provided with an integrally molded support member 26 which functions to hold the various wafers rigidly in position in such a manner as to define the various scoring areas. In order to delineate the different scoring areas on the front portion of the board 10, the dart board support member 26 is provided with an integrally molded web arrangement generally indicated at 28. The web includes a series of circumferentially extending ribs 30 and a series of radially extending ribs 31 disposed in front of the wafers. The circumferentially extending ribs 30 define the peripheral boundaries of the various circumferential rows of target areas for the dart board. The radially extending ribs 30 of the web 28 extend along the margins of the wafers in such a way that a single rib is positioned between adjacent margins of adjacent wafers. As is conventional in the case of safe dart boards, each rib 30 is substantially of a triangular cross section with inwardly sloping equilateral sides. This results in an arrangement with allows a thrown dart which strikes one of the ribs to slide inwardly along one of the sloped sides until the tip of the dart enters one of the holes 14 instead of bouncing off the rib.

Each of the circumferential ribs 30 is provided on its side remote from the facing surface of the dart board with an annular wall 32 which extends inwardly from and is centered relative to each of the circumferential ribs 30, with the inner edge of the annular wall 32 abutting the inner edge of the circumferential ribs. Also provided in an integrally molded fashion to the walls 35 are web-like members 34 which are centered relative to and extend inwardly from the radial ribs 31. Since the annular walls 32 and the web-like members 34 are integrally molded with the circumferential ribs 30 and the radial ribs 31, respectively, a discrete structure results which functions to support and reinforce the ribs.

According to common practice, the wafers 12 are so positioned on the dart board that immediately adjacent wafers are of different colors in order to visually highlight the individual scoring areas defined by the wafers. Generally a bi-color arrangement is chosen in defining the various target areas. This type of arrangement is illustrated in FIG. 1 where alternate wafers in each of the circumferential rows are of the same color. More specifically, considering the outer most circumferential row 22, the wafers 12*a* and 12*c* are made to be of one color, say yellow, while the adjacent alternate wafers 12*b* and 12*d* are made of a different color, say red. This alternating color arrangement is followed through the outer circumferential row 22. A similar arrangement is followed in the remaining three circumferential rows 20, 18, and 16. The color arrangement is also chosen in such a way that adjacent wafers between different circumferential rows are also of different colors. For example, in the circumferential row 20, the wafer 12*e* which is immediately adjacent to the wafer 12*a* of circumferential row 22 is made to be of a different color, in this case red, than the wafer 12*a*. The wafer 12*g* which is two positions removed from the wafer 12*e* is also made to be red in color. The adjacent alternating wafers 12*f* and 12*h* in the circumferential row 20 are made of the second color, i.e., yellow. This type of arrangement is followed through all the circumferential rows of the dart board so that individual scoring areas are delineated very clearly by virtue of the fact that all adjoining wafers are of different colors.

Figure 3:
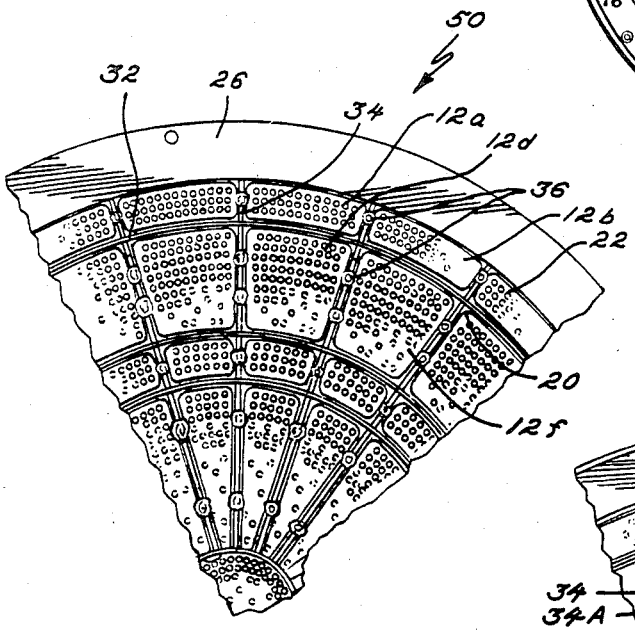
FIG. 3 is a segmented top view illustrating the rear portion of a conventional dart board and showing clearly the separate positioning of the various differently colored scoring areas.

According to conventional practice, each of the 81 wafers which define the distinctive scoring areas for the target area of the dart board are separately molded in their required colors and each of these separately molded wafers is then individually positioned into its corresponding position within the supporting infrastructure of the dart board by using some kind of heat welding means. Such an arrangement is illustrated in FIG. 3 which is a segmented top view of the rear portion of a conventional dart board assembled by using separately molded and differently colored wafers. As shown in FIG. 3, the main support structure 26 of the dart board 50 is provided with integrally molded annular walls 32 which extend inwardly from and are centered relative to each of the circumferential ribs defined on the front portion of the dart board. Also, integrally molded with the support structure 26 are the web-like members 34 which are centered relative to and extend inwardly from the radial ribs 30 on the front portion of the dart board. The web-like members are also made integral with the annular walls 32.

During assembly of such conventional dart boards, the separately molded and differently colored target wafers 12 are individually placed into their respective positions within the target area as defined by the meshing of the annular walls 32 with the radially extending web members 34. For example, in the outermost circumferential row similarly shaped but differently colored wafers 12*a* and 12*b* are positioned adjacent to each other. Similarly, in the circumferential row 20, similarly shaped yet differently colored wafers 12*d* and 12*f* are positioned in such a way that the wafers 12*a*, 12*d* and 12*b*, 12*f* in adjacent circumferential rows are of different colors. Each of the target area positions defined by the meshing of the web members and the annular walls is filled by the corresponding separately molded wafer. After all the wafers have been properly positioned, conventional heat welding techniques are used to firmly anchor these wafers by providing a plurality of heat welds 36 which effectively join together adjacent wafers in each circumferential row. The heat welds 36 are formed in such a way that each weld fuses together a portion of the plastic material of the adjacent wafers being joined together with the plastic material of the web member lying in between the adjacent wafers being joined. For instance, the weld 36 joins together the wafers 12*a* and 12*b* and also joins them to the web member 34 lying in between the wafers. The heat welds 36 are provided at various spots along the radial length of the web members 34 and the number of heat welds provided within a given circumferential row is dependent upon the overall size of the wafers contained within that circumferential row. It is common to provide just one heat weld in order to join adjacent wafers in the second and the fourth circumferential rows whereas two or more heat welds may be provided for adjoining adjacent wafers in the first and third circumferential rows. The wafer 24 which represents the bulls-eye for the dart board is anchored into its central position in a similar manner by the use of a heat weld which fuses together the plastic material on the periphery of the wafer and the plastic material of either a web member or the annular wall that is immediately adjacent to the periphery of the wafer.

As is apparent, such a conventional assembly procedure is extremely laborious and time consuming since each of the wafers representing the distinctive scoring areas of the dart board has to be individually placed in its corresponding position on the support structure of the dart board. More specifically, as part of the assembly line procedure during assembly of the dart board, the assembler has to go through 81 separate motions of picking up an individualized target wafer and then placing it into the proper position on the dart board. The assembly operation is further complicated since the assembler has to recognize and pick out a target wafer of the right shape as well as the right color before placing it into its proper position on the dart board target area. This type of conventional assembly method is unduly time consuming and in the final analysis laborious, inconvenient and uneconomical. It is also quite obvious that the complexity of the assembly procedure increases as the number of colors used to define the respective target areas of the dart board increases.

Figure 4:
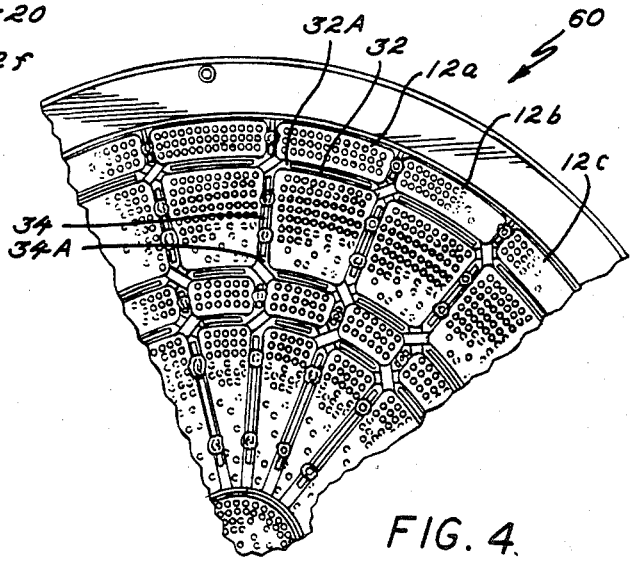
FIG. 4 is a segmented top view of the rear portion of the illustrious dart board according to this invention.
Figure 5:
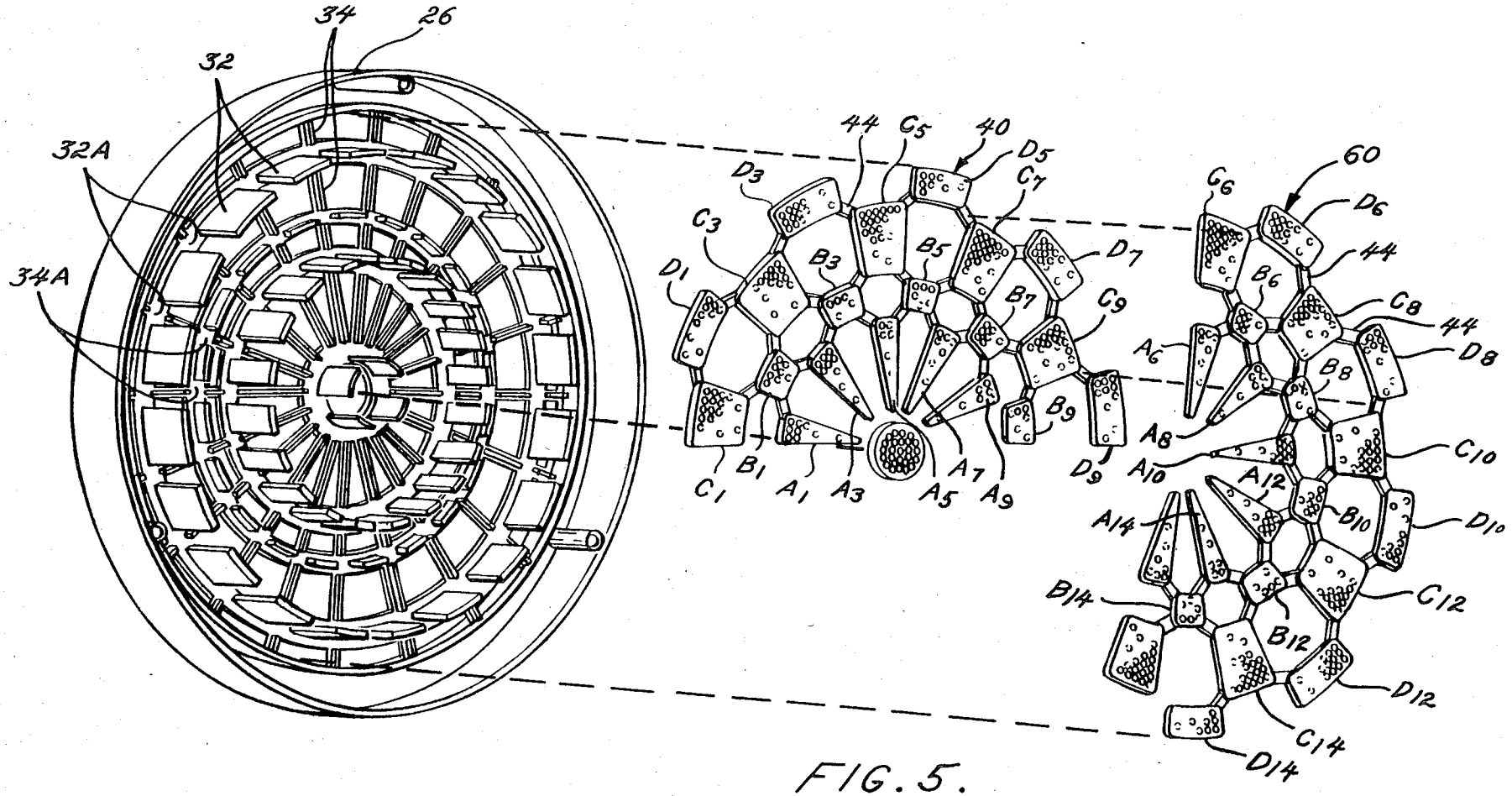
FIG. 5 is an exploded rear view of the illustrative dart board showing two of the integral grids in relation to the dart board infrastructure.

According to a novel aspect of this invention, the disadvantages inherent to the conventional method of assembly are removed by an assembly arrangement which requires a significantly reduced number of assembly operations as the dart board is being assembled. Such an improved arrangement is shown in FIG. 4 which is a segmental top view of the rear portion of the illustrative dart board according to this invention and in FIG. 5 which is an exploded view of such an improved dart board. As shown in FIGS. 4 and 5, wafers of the same color in all the four circumferential rows are linked together to form a grid like structure in which the respective positions of the similarly colored wafers correspond exactly to the positions of the wafers on the corresponding target areas on the dart board. The 80 wafers, excluding the single 'bulls-eye' wafer, which define the overall target area of the dart board are linked together on the basis of their color into a plurality of grid like structures, of which only two grid structures 40 and 60 are shown (FIG. 5). Taking the case of a dart board in which the target areas have been delineated on the basis of just two distinct colors, the 80 wafers (excluding the bulls-eye wafer) are selectively linked together to form two pairs of integral grid-like structures, each pair consisting of two separate yet complimentary grids comprising wafers of one of the two distinct colors.

The first pair of grid structures comprises the grids 40 and 40', of which only one grid 40 is shown since the corresponding grid 40' is identical in all respects, and accounts for all wafers of the first distinct color. The grid 40 is composed of the five alternately positioned wafers D1, D3, D5, D7 and D9 of the outermost circumferential row 22, the five alternating wafers C1, C3, C5, C7 and C9 of the third circumferential row 20, the five alternating wafers B1, B3, B5, B7 and B9 of the second circumferential row 18, and the five alternating wafers A1, A3, A5, A7 and A9 of the innermost circumferential row 16. Each of these 20 wafers which constitute the grid 40 is attached permanently to the wafer or wafers immediately adjacent to it by means of coupling links 44. For example, the wafer D5 in the outermost circumferential row is linked to the adjacent wafers of the same color C5, C7 in the adjacent circumferential row 20 by a pair of coupling links 44. In the case of wafers in the second circumferential row 18, which has two circumferential rows 16 and 20 adjacent to it, each wafer is linked to the four wafers of the same color which are adjacent to it. For example, the wafer B5 is linked to the wafers C5 and C7 of the third circumferential row 20 and to wafers A5 and A7 of the first circumferential row 16 by separate coupling links 44.

It will be noted that the wafer grid 40 covers only half the overall target area for the dart board. An identical grid 40' (not shown) is provided to cover the remaining half portion of the dart board target area. The second grid is structured basically in the same way as the first grid 40 and is composed of the remaining wafers within the dart board target area which have the same color as that of the wafers in the first grid 40. More specifically, the second grid contains the remaining five wafers D11, D13, D15, D17 and D19 in the outermost circumferential row 22, the remaining five wafers C11, C13, C15, C17 and C19 of the third circumferential row 20, the remaining five wafers B11, B13, B15, B17 and B19 of the second circumferential row 18 and the remaining five wafers A11, A13, A15, A17 and A19 of the innermost circumferential row 16, which are of the same color as the wafers in the corresponding grid portion 40. The two complementary grids 40 and 40' in combination provide a linked arrangement defining the desired positions of all wafers within the target area of the dart board which have the same one of the two distinctive target area colors.

A similar complementary grid like structure is provided for wafers within the target area which have the second one of the two distinctive target area colors. For instance, the wafer grid structure 60 consists of the five alternating wafers D6, D8, D10, D12 and D14 of the outermost circumferential row 22, the five alternating wafers C6, C8, C10, C12 and C14 of the third circumferential row 20, the five alternating wafers B6, B8, B10, B12 and B14 of the second circumferential row 18, and the five alternating wafers A6, A8, A10, A12 and A14 of the innermost circumferential row 16. All the 20 wafers comprising the grid structure 60 are of the same color (which is different from the color of the wafers in grids 40 and 40') and are linked to immediately adjacent wafers by means of the coupling links 44.

As in the case of the wafer grids 40 and 40', the wafer grid 60 covers only half the area of the dart board target area. A complementary wafer grid 60' is provided to cover the remaining half of the target area and is identical to the wafer grid 60 in construction. More specifically, the complementary grid 60' (not shown) comprises the remaining five wafers D16, D18, D20, D2 and D4 of the outermost circumferential groove 22, the remaining five wafers C16, C18, C20, C2 and C4 of the third circumferential row 20, the five remaining wafers B16, B18, B10, B2 and B4 of the second circumferential row, and the remaining five wafers A16, A18, A20, A2 and A4 of the innermost circumferential row 16, which have the same color as the wafers forming grid 60. The complementary wafer grids 60 and 60' thus in combination define the desired positions of all the wafers within the target area of the dart board which possess the same color which is different from the color of the wafers defined by grids 40 and 40'. The two pairs of wafer grid structures are also structured in such a manner that permits grids of one color (60, 60') to be easily stacked in an overlapping manner with grids of the other color (40, 40'), and yet allow placement of the individual wafers into their corresponding positions on the dart board. The above arrangement, according to the system of this invention, provides an extremely easy and convenient method of assembly for positioning of the various wafers onto their designated areas in the dart board target area. More specifically, the assembly procedure for the wafers now requires only four discrete operations. During assembly, instead of selecting the correct size and shape of every single wafer and subsequently positioning the wafer into its corresponding position within the target area of the dart board, the person performing the assembly first has to position the wafer grids 40, 40' of the same color onto the dart board target area and then position the wafer grids 60, 60' of the second selected color over the grids 40, 40' within the support structure 26 of the dart board. The bulls-eye wafer 24 which is a separately molded and non-linked wafer can be positioned onto the target area at any time during the assembly either before or after placement of the wafer grids.

According to a feature of this invention, provision is made on the support structure of the dart board for receiving and accommodating the various coupling links utilized in the formation of the complementary grids 40, 40' and 60, 60'. More specifically, the annular walls 32 which project inwardly from the circumferential ribs 30 defined on the integral dart board support structure 26 are provided with a plurality of slots **32*a* whose positions along the circumferential extension of the annular walls are predefined in such a way as to correspond to the positions of the plurality of coupling links which join the various similarly colored wafers within the complimentary grids. More specifically, the slots within the annular walls are provided at the junction of adjacent wafers within the vicinity of the radially extending web members 34. In a similar manner the web-like members 34 are also provided with slots 34*a* which are defined along the radial length of the web members in such a way as to correspond with the positions of the coupling links joining adjacently positioned and similarly colored wafers. The slots 32***a* and 34*a* thus, provide convenient means for positioning the complementary wafer grids along with the plurality of coupling links which define the grids.

The assembly procedure for a dart board according to the system of this invention is extremely simplified since it basically involves the placement of the complementary grids 40 and 40' which correspond to wafers with one of the two preselected colors onto the integrally molded dart board support structure 26 in between the slots 32*a* on the annular walls 32 and the slots 34*a* on the web members 34, and the subsequent placement of the complementary grids 60 and 60' which consist of wafers having the other of the two preselected colors onto the support structure 26 in between the slots provided on the annular walls and the web members. More specifically, the assembly of the dart board wafers, excluding the single bulls-eye wafer, on the basis of the illustrative four grid wafer structure involves only four simple assembly operations:

(1) positioning of the grid structure 40 onto its proper position within the target area defined on integral support structure 26, (2) positioning of the complementary grid 40' into its corresponding position opposite the complementary grid 40 within the support structure, (3) placement of the grid structure 60 into its corresponding position over grids 40 and 40' within the support structure, and (4) placement of the complimentary grid 60' into its corresponding position opposite the grid 60 within the support structure.

It must be noted that the choice of two separate complementary grids for wafers of the same color (40, 40' and 60, 60') is made from the point of view of convenient molding of the various wafers and their coupling links into an integral grid structure. It is, however, possible to mold the various wafers of the same color and their coupling links in the form of a single wafer grid which covers the overall target area of the dart board. This type of arrangement would result in only two separate grid like structures for the two preselected colors for delineating the target areas of the dart board. Such an arrangement would further simplify the assembly procedure since the basic wafer assembly operations are essentially reduced from four, as in the illustrative embodiment, to two operations.

It will also be noted that the grid-like arrangement of the various wafers constituting the target area provides added structural strength to the dart board. This is because the linking together of the individual wafers to form a grid reduces the possibility of an individual wafer being dislodged from its position on the target area as a result of the consistent jarring forces to which the board is subjected to over its playing life.

As apparent from the foregoing, the illustrative wafer grid arrangement of this invention effectively brings about a significant reduction in the total number of individual wafer assembly operations in the assembly of the improved dart board, as compared with conventional dart boards. In addition, this arrangement contributes to reduced manufacturing and inventory related costs because of the drastically reduced number of discrete components required for assembly. The invention thus provides an improved dart board requiring a convenient and simple assembly procedure which causes reduced fatiguing of the assembly operator, which is significantly less susceptible to assembly errors, and which can be manufactured with increased production efficiency as a result of reduced labor and time related assembly costs.

I claim:

1. A dart board having a target area with a plurality of differently colored scoring areas defined on it, said board having an integral support structure with means for supporting an array of target plates disposed in edge-to-edge relation within said target area so as to define said scoring areas, each of said plates having a plurality of closely spaced holes molded in the outer face thereon, said array of target plates being divided into a plurality of predefined groups, with adjacent plates in each group being linked together by integral fastening means to form an integral grid-like structure, said grid-like structures adapted to be supported within said integral support structure in an overlapping relationship with each other so as to define in combination said different scoring areas on said dart board.

2. The dart board of claim 1 wherein said support structure includes ribs located outwardly of said target plates, with adjacent margins of adjacent plates having one rib disposed between them.

3. The dart board of claim 2 wherein the ribs include a set of circumferentially extending ribs and a set of radially extending ribs disposed at predefined positions on the target area.

4. The dart board of claim 3 wherein the support structure further includes annular walls extending inwardly from and centered relative to each of said circumferentially extending ribs, and support members extending inwardly from and centered relative to said radially extending ribs, whereby said annular walls and said support members function to reinforce said ribs.

5. The dart board of claim 4 wherein said annular walls and said support members are provided with a plurality of slots which are disposed about the adjacent corners of adjacent wafers in such a way as to allow the grid-like structures to be positioned in said overlapping relationship with each other.

6. The dart board of claim 5 wherein each of said groups of target plates comprises target plates of the same color.

7. The dart board of claim 6 wherein said scoring areas are defined by two colors, and said target plates are grouped and linked together to form two pairs of grid-like structures, each pair comprising target plates of a different one of said two colors.

8. The dart board of claim 7 wherein said colors are red and black.

* * * * *